US005931366A

United States Patent [19]

Muro

[11] Patent Number: 5,931,366

[45] Date of Patent: Aug. 3, 1999

[54] SUCCESSIVE SCREW FEEDER DRIVER

[75] Inventor: Narahiko Muro, Tokyo, Japan

[73] Assignee: Muro Corporation, Tokyo, Japan

[21] Appl. No.: 08/980,894

[22] Filed: Dec. 1, 1997

[30] Foreign Application Priority Data

Mar. 17, 1997 [JP] Japan ..... 9-084543

[51] Int. Cl.[6] ..... B25B 23/04

[52] U.S. Cl. ..... 227/137; 227/8; 227/136; 81/434

[58] Field of Search ..... 227/120, 131, 227/135, 136, 137, 8; 81/434; 173/216, 217

[56] References Cited

U.S. PATENT DOCUMENTS

| | | | |
|---|---|---|---|
| 3,656,520 | 4/1972 | Caffa | 227/136 |
| 3,982,678 | 9/1976 | Olson | 227/136 |
| 4,014,488 | 3/1977 | Potucek et al. | 227/136 |
| 4,199,014 | 4/1980 | Nickle | 227/120 |
| 4,517,863 | 5/1985 | Ishikawa . | |
| 4,807,498 | 2/1989 | Kleiser et al. | 81/434 |
| 5,109,738 | 5/1992 | Farian et al. | 81/434 |
| 5,570,618 | 11/1996 | Habermehl et al. | 81/434 |

FOREIGN PATENT DOCUMENTS 62-6955 2/1987 Japan .

*Primary Examiner*—Scott A. Smith
*Attorney, Agent, or Firm*—Sughrue, Mion, Zinn, Macpeak & Seas, PLLC

[57] ABSTRACT

A successive screw feeder driver includes a grip handle, a rotating mechanism provided on the upper side of the grip handle, a screw driving bit attached removably to the front portion of the rotating mechanism, a reduction mechanism formed above the rotating mechanism and a drive unit for rotating the bit. The drive unit is connected to the reduction mechanism and is positioned behind and above the grip handle. A screw feed mechanism body is mounted on the front portion of the grip handle and is slidable in the longitudinal direction with the bit being inserted rotatably into the screw feed mechanism body. A supporting and pushing portion extends from the upper portion of the rear end of the grip handle to a lower surface of the housing for the drive unit beyond the position where a virtual rotation line extending rearward of the axis of the bit is formed. A screw feed mechanism is provided in the screw feed mechanism body for feeding screws successively to a screw driving position. The screws are carried on a screw chain side by side in a belt-like arrangement.

5 Claims, 4 Drawing Sheets

SUCCESSIVE SCREW FEEDER DRIVER

TECHNICAL FIELD

The present invention relates to a successive screw feeder driver for feeding and driving screws successively into a plate such as, for example, wooden plate or metallic plate to fix the plate to a wall surface, a floor surface, or the like. Particularly, the invention is concerned with a successive screw feeder driver capable of transmitting the operator's supporting and pushing force for a grip handle of the driver exactly in the direction of a rotational axis of a screw driving bit.

BACKGROUND ART

Heretofore there have been proposed successive screw feeder drivers capable of successively feeding and driving screws into a plate such as, for example, wooden plate or metallic plate to fix the plate to a wall surface, a floor surface, or the like, (hereinafter referred to as "a wall surface or the like"). For example, a conventional successive screw feeder driver of this type is shown in FIG. 5. In this conventional successive screw feeder driver 51, a grip handle 54 is formed and mounted in a generally T-shape below a screw driving mechanism body 53 which incorporates a drive unit 52 therein, and a screw driving rod-like bit 55, which corresponds to the screwdriver as a commonly-used tool, is connected to the drive unit 52 in the front portion of the screw driving mechanism body 53. The bit 55 is rotated to drive screws. This type is popular.

In the above conventional screw feeder driver 51, however, when the operator grasps the grip handle 54 and pushes the tip end of the bit 55 against the surface of a plate or the like, if the screw driving mechanism body 53 is pushed strongly against a wall surface or the like during the work, a force of rotating downward to the front (in the direction of arrow A) is generated in the body 53, centered on the screw portion being driven to the wall surface or the like, because a pushing direction F of the operator's hand and an axial direction of a virtual rotation line CL of the bit 55 which drives the screw are vertically spaced and separated from each other. Therefore, the operator is required to not only push the tip end of the bit in the screw driving direction continually but also prevent the lower portion of the grip handle 54 from rotating downward to the front (in the arrow A direction). Thus, the operator is required to apply an extra force to the wrist, and there arises the problem that when the work is continued over a long time, not only the operator's palm which grasps the grip handle but also his or her wrist is apt to become tired to excess.

In the conventional successive screw feeder driver 51, if the screw driving mechanism body 53 tilts during the screw driving work, the screw will be driven inclinedly relative to the surface of the plate or the like, so that a part of the screw head is protruded from the wall surface or the like and from the surface of the plate. Thus, the appearance of the screw after driving is deteriorated.

In the case of the grip handle 54 of a simple, generally cylindrical shape used in the conventional successive screw feeder driver 51, as shown in FIG. 6, there occurs a clearance between the surface of the grip handle 54 and the recess of the palm C. In other words, the palm C does not fit the rear face of the grip handle 54 perfectly. Accordingly, as the screw driving work is continued over a long time, the operator becomes tired in the palm and the grasping power is deteriorated.

The present invention has been accomplished in view of the above-mentioned problems and it is an object of the invention to provide a successive screw feeder driver wherein a screw driving direction of a grip handle, namely a virtual rotation line of a bit, and a pushing direction line of an operator's hand are made substantially coincident with each other, a housing which houses a drive unit therein is positioned above the position where the virtual rotation line of the bit is formed, and a supporting and pushing portion of a grip handle is formed on the lower surface of the housing, thereby permitting a pushing force of the palm to be transmitted to the front of the bit axis exactly and effectively at the time of driving a screw.

SUMMARY OF THE INVENTION

According to the present invention there is provided a successive screw feeder driver comprising a grip handle, a rotating mechanism provided on the upper side of the grip handle, a screw driving bit attached removably to the front portion of the rotating mechanism, a reduction mechanism formed above the rotating mechanism, a drive unit for rotating the bit, the drive unit being connected to the reduction mechanism so as to be positioned behind and above the grip handle, a screw feed mechanism body which is mounted to the front portion of the grip handle and which is slidable in the longitudinal direction, with the bit being inserted rotatably into the screw feed mechanism body, a housing which houses the drive unit therein, a supporting and pushing portion extending from the upper portion of the rear end of the grip handle to the lower surface of the housing beyond the position where a virtual rotation line extending rearward of the axis of the bit is formed, the supporting and pushing portion being curved so that the palm portion of an operator including the base portion of the operator's thumb and forefinger can push the rear end of the virtual rotation line when the operator grasps the grip handle, and a screw feed mechanism provided in the screw feed mechanism body for feeding screws successively to a screw driving position for screw driving with the bit in interlock with the longitudinal sliding motion of the screw feed mechanism body which motion is synchronized with the screw driving operation performed by the bit, the screws being carried on a screw chain side by side in a large number and in a belt-like arrangement.

The supporting and pushing portion of the grip handle may be formed so as to be gently curved at the upper portion of the grip handle and then projected rearward. The grip handle may be formed below a substantially centroid portion of the body of the screw feeder driver, and its supporting and pushing portion may be formed to have a thickness almost equal to the thickness of the screw feed mechanism body.

According to the successive screw feeder driver of the present invention, since the supporting and pushing portion formed at an upper position of the rear portion of the grip handle and including a virtual rotation line extending rearward of the axis of the bit can be pushed by the base portion of the operator's thumb and forefinger and the operator's palm portion, the line of action of the operator's hand which pushes the screw driving mechanism body is positioned substantially aligned with the bit axis, so that screws can be pushed against a wall surface or the like and driven always in a stable state.

Moreover, since the supporting and pushing portion of the grip handle is projected rearward from the upper portion of the grip handle contiguously to a curved surface which is gently curved from the lower to the upper portion of the grip handle, it is possible to let the grip handle to fit the recess of the palm closely without leaving any clearance, and hence the operator does not become tired even when the screw driving work is continued for a long time.

Further, since the supporting and pushing portion of the grip handle has a thickness almost equal to the thickness of the screw feed mechanism body, the grip handle can be grasped firmly by the base portion of the operator's thumb and forefinger. Besides, since the drive unit which is the heaviest component in the screw driving mechanism body can be borne just above the operator's wrist which grasps the grip handle, there can be obtained a stable grasping power and the operator does not get tired even after using the screw driving mechanism body for a long time.

According to the above construction, each screw can be driven gradually into a wall surface or the like by pushing the bit against the screw under rotation of the drive unit while the front end of the screw feed mechanism body with a screw chain loaded therein is thrust against the wall surface or the like. Next, when the front end of the screw feed mechanism body is disengaged from the wall surface, the screw feed mechanism body is pushed out to its original position. At the same time, the screw feed mechanism operates to feed the next screw on the screw chain to the screw driving position. Thus, the screw driving work can be done successively by the same operations as above.

DESCRIPTION OF THE PREFERRED EMBODIMENTS

Figure 1:
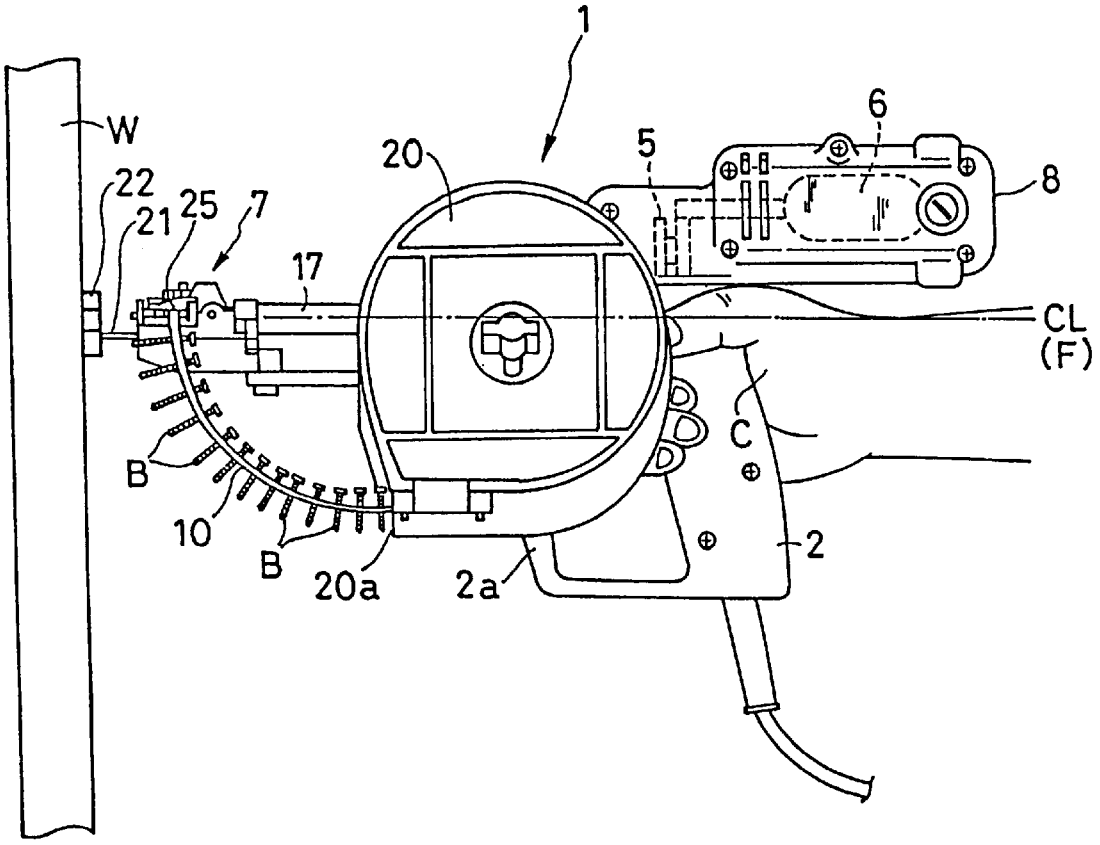
FIG. 1 is a side view of a successive screw feeder driver embodying the present invention, as grasped by an operator.

A successive screw feeder driver according to a preferred embodiment of the present invention will be described hereinunder with reference to the accompanying drawings.

As shown in FIGS. 1 to 4, which illustrate the successive screw feeder driver, a bit 4 for driving screws B is mounted removably in the front portion of the successive screw feeder driver 1, through a rotating mechanism 3 disposed on the upper side of a grip handle 2, and a reduction mechanism 5 is formed above the rotating mechanism 3. A drive unit 6 for rotating the bit 4 through the reduction mechanism 5 is connected to the reduction mechanism so as to be positioned above the rear portion of the grip handle 2. A screw feed mechanism body 7, which is slidable in the longitudinal direction, is attached to the front portion of the grip handle 2, and the bit 4 is inserted rotatably into the screw feed mechanism body 7. The drive unit is housed within a housing 8. Further, an arcuate supporting and pushing portion 9 extended from the upper portion of the rear end of the grip 2 to the lower surface of the housing 8 extends beyond a virtual rotation line CL extending rearward of the axis of the bit 4. The supporting and pushing portion 9 is curved so that when grasping the grip handle 2, an operator can push the rear portion of the virtual rotation line CL at his or her palm portion C including the base portion of the thumb and the forefinger. A large number of screws B, B, . . . are carried side by side in a belt-like fashion on a screw chain 10, and the screw chain 10 is allowed to slide toward a feed mechanism portion 11 of the screw feed mechanism body 7 as each screw B is driven by the bit 4. In this way the screws are fed interlockedly to the screw driving position for driving with the bit 4.

Along the lower surface of the housing 8 which houses the drive unit 6 therein the rear portion of the grip handle 2 extends rearward of the virtual rotation line CL of the bit 4 to form the supporting and pushing portion 9 which is curved. When the operator grasps the grip handle 2, the base portion of the operator's thumb and forefinger comes into abutment with the supporting and pushing portion 9, whereby the successive screw feeder driver 1 itself is supported at its centroid portion and is thereby held stably. Besides, it becomes possible to perform the screw driving operation while pushing the supporting and pushing portion 9 forward by the palm C. Thus, a line F of the palm's pushing action acting to push the successive screw feeder driver 1 forward comes substantially into alignment with the virtual rotation line CL of the bit 4. In this way the screw driver feeder 1 is always held in a stable posture and hence the bit 4, i.e., screw B can be pushed against the wall surface or the like.

In this embodiment, a protective frame 2*a* is integrally connected at its lower end portion to the front side of the grip handle 2 to protect the hand's back of the operator grasping the grip handle 2. These components are positioned nearly centrally of the lower portion of the successive screw feeder driver 1 to support the driver 1 at two front and rear points and thereby improve the stability thereof.

More specifically, the axis of the virtual rotation line CL of the bit 4 and the pushing action line F of the palm C acting to push the bit 4 forward are substantially aligned with each other, so when the operator pushes the successive screw feeder driver strongly against the wall W, the pushing action line F performs a straight forward push-out motion along the virtual rotation line CL. Consequently, it is possible to avoid inconveniences of the conventional successive screw feeder driver such as arcuate rotation of the grip handle in the downward and forward direction A with the front end portion of the bit as the rotation center during screw driving and the resulting loss of stability and an inclined driven posture of the screw against the wall surface or the like. Besides, it is no longer required for the operator to apply an extra force to his or her palm C and wrist, thus eliminating the fear of increased fatigue of the wrist even when the screw driving work is continued for a long time.

Figure 2:
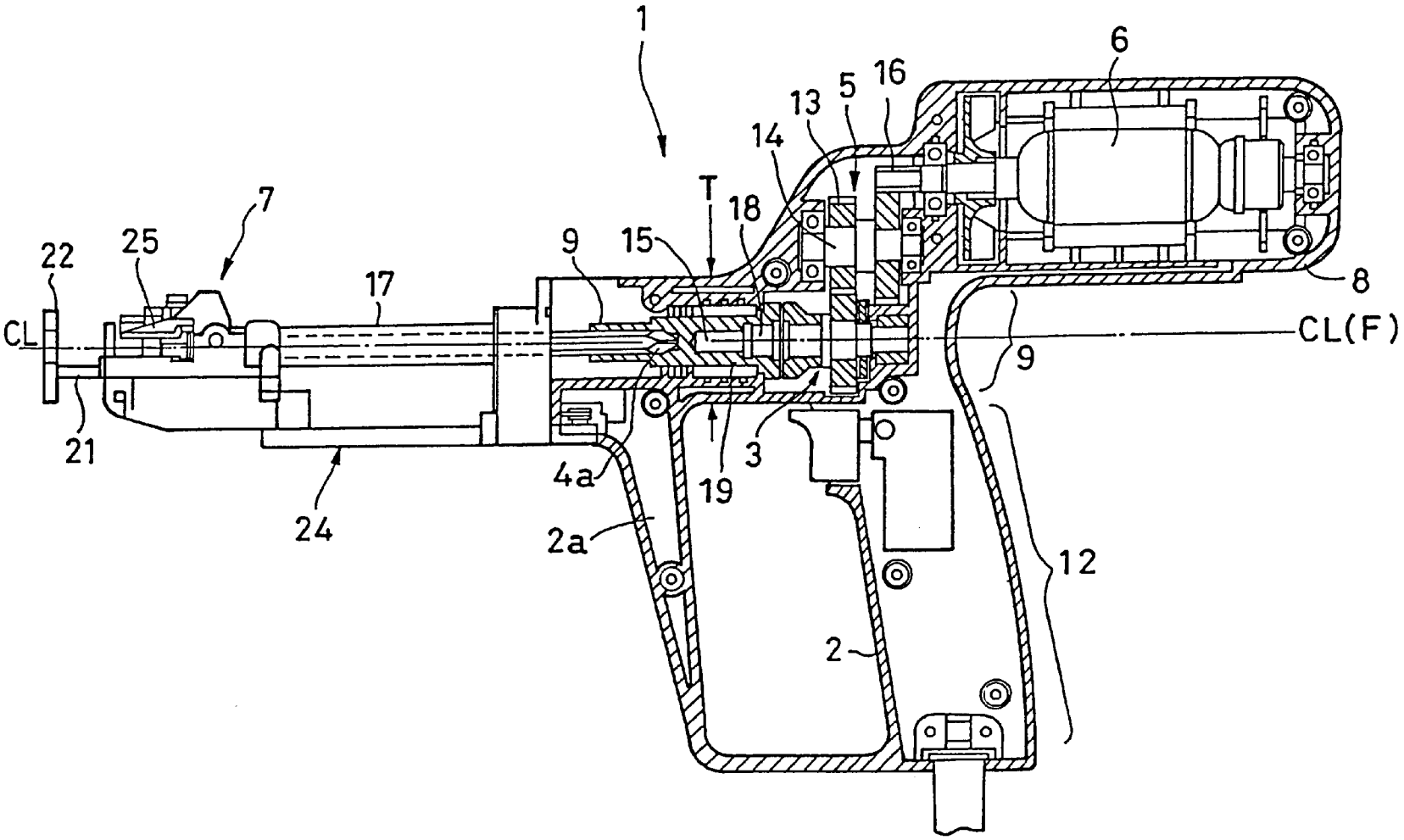
FIG. 2 is a partial sectional side view showing a drive unit and a reduction mechanism both used in the successive screw feeder driver.
Figure 3:
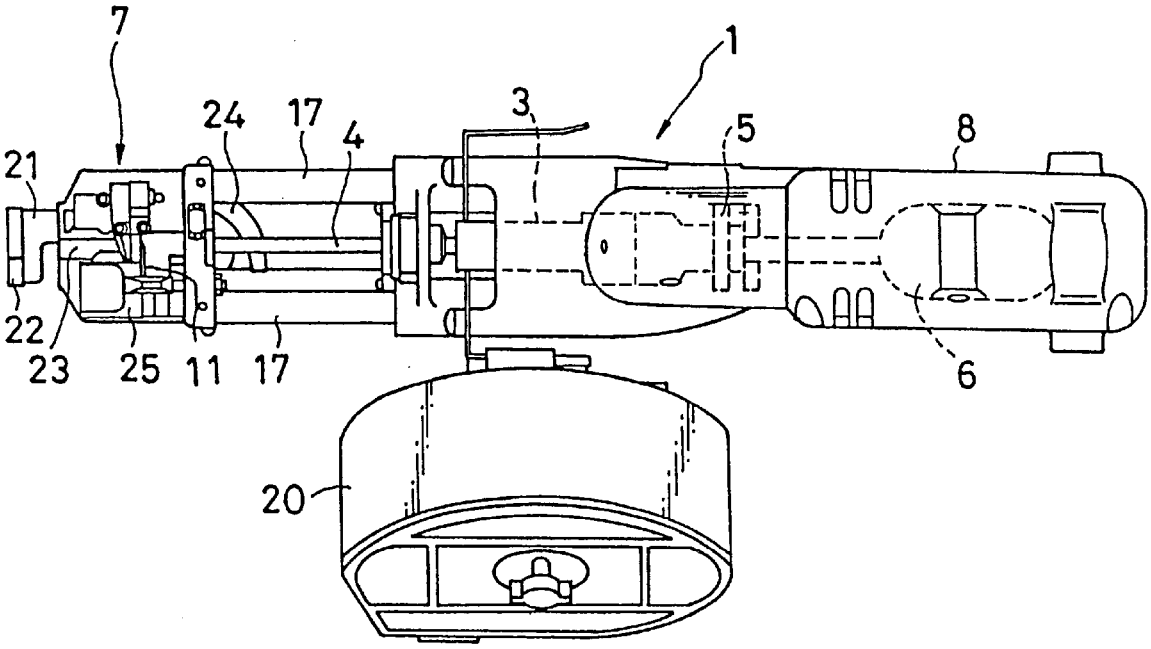
FIG. 3 is a plan view thereof.
Figure 4:
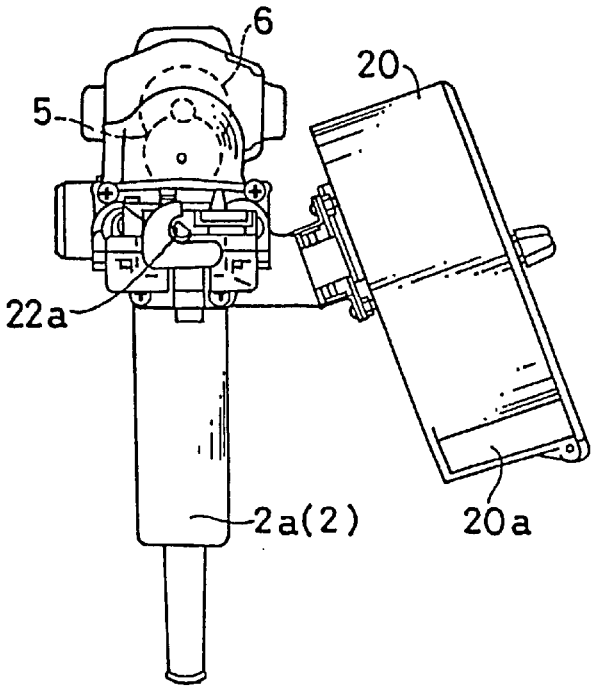
FIG. 4 is a front view thereof.
Figure 5:
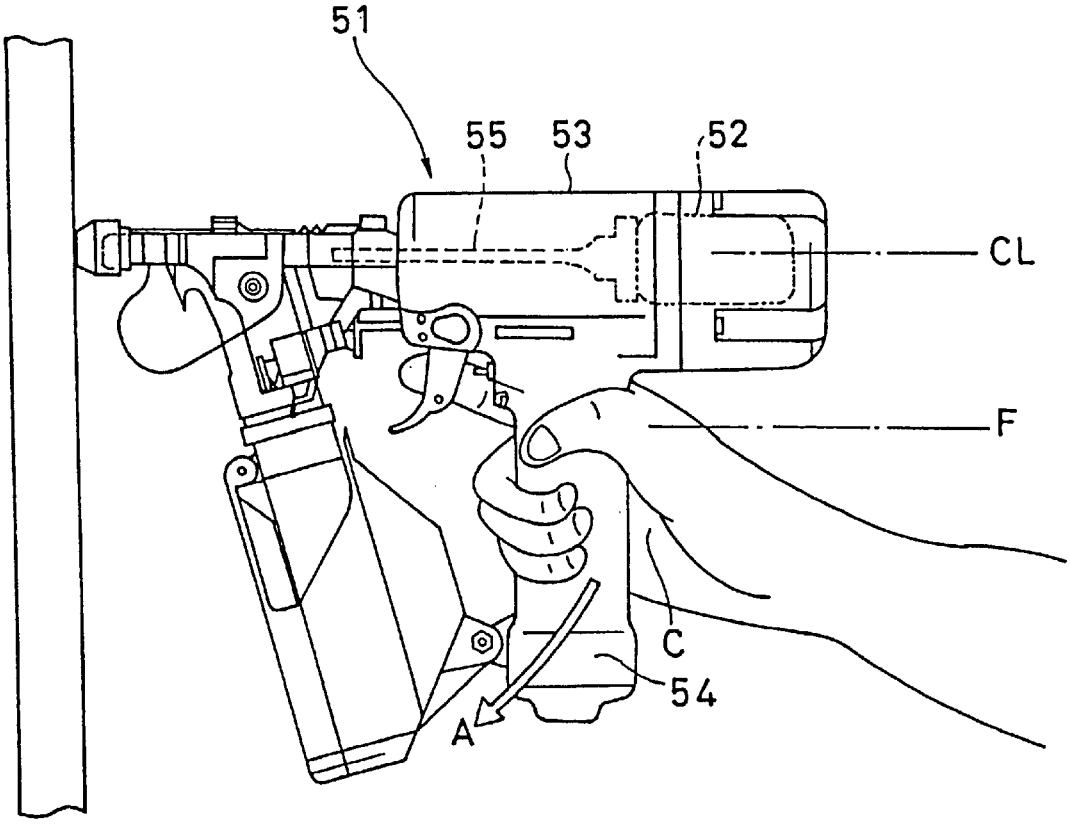
FIG. 5 is a side view of a conventional successive screw feeder driver as grasped by an operator.
Figure 6:
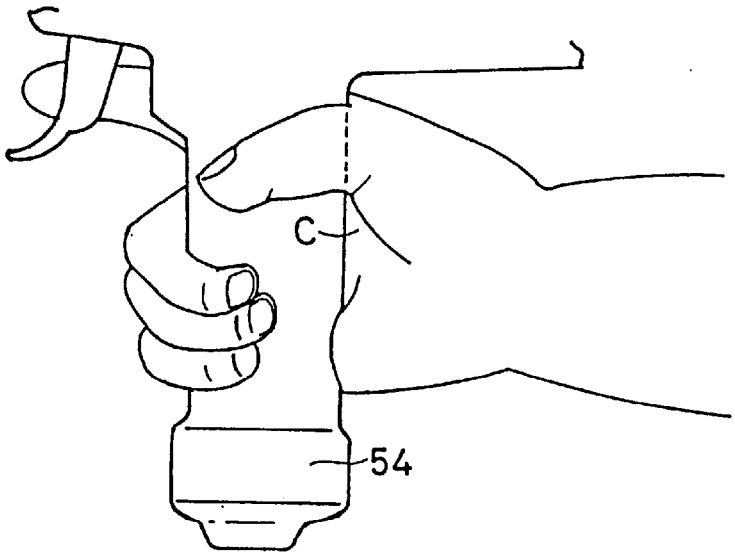
FIG. 6 is a partial enlarged side view of a grip handle of the conventional successive screw feeder driver as grasped by an operator.

According to this embodiment, as shown in FIG. 2, a gently rearwardly curved portion 12 is formed from the lower to the upper portion of the grip handle 2. The curved portion 12 is contiguous to the supporting and pushing portion 9 of the grip handle 2 to provide an integral form. This integral portion constitutes a characteristic portion of the grip handle 2 in the successive screw feeder driver 1. The supporting and pushing portion 9 contiguous to the lower surface of the housing 8 which houses the drive unit 6 such as, for example, an electric motor or an air motor, as well as the curved portion 12, permit the grip handle 2 to fit the recess of the palm C of the operator grasping the grip handle closely without leaving any clearance. Therefore, even when the operator performs the screw driving work over a long time while grasping the grip handle 2 of the successive screw feeder driver 1, he or she will not get tired in the hand.

As shown in FIG. 2, moreover, since the supporting and pushing portion 9 of the grip handle 2 has a thickness almost equal to the thickness T of the screw feed mechanism body 7, the grip handle 2 can be grasped firmly by the base portion of the operator's thumb and forefinger. Besides, the constituent portion of the drive unit 6 which is the heaviest in the successive screw feeder driver 1 can be borne just above the operator's wrist which grasps the grip handle 2. Thus, the successive screw feeder driver 1 is supported by the whole of the hand and can be grasped firmly by using the grasping power of the palm C in an auxiliary manner. That is, even a long-hour work does not cause fatigue of the wrist.

As described above, in the successive screw feeder driver 1 of this embodiment the reduction mechanism 5 is interposed between the rotating mechanism 3 for rotating the bit 4 and the drive unit 6 so that the number of revolutions of the bit 4 can be changed as desired. A rotating shaft 14 supports rotatably a gear device 13 which constitutes the reduction mechanism 5, and it is disposed above a rotary shaft 15 which is mounted coaxially behind the bit 4. Further, the rotary shaft 14 is connected through the gear device 13 to a drive shaft 16 of the drive unit 6 which drive shaft is positioned above the gear device. The shafts 14, 15 and 16 so arranged also serve as factors for characteristically defining the vertical position of the supporting and pushing portion 9 relative to the virtual rotation line CL of the bit 4 which portion 9 is formed upward at the rear portion of the grip handle 2.

The screw feed mechanism body 7 is attached to the front portion of the grip handle 2 through a pair of guide poles 17,17 so as to be slidable longitudinally. Between and in parallel with the paired guide poles 17,17 is disposed the bit 4 for driving the screws B. The bit 4 is connected removably to a chuck 19 which is rotatable through a clutch 18 as a constituent of the rotating mechanism 3. To a side face of the grip handle 2 is attached removably a magazine 20 which receives therein the screw chain 10 in a rolled state. The screws B carried side by side on the screw chain 10 can be fed successively out of a take-out port 20*a* of the magazine 20.

It goes without saying that the mounting method and posture of the magazine 20 for the successive screw feeder driver 1, as well as the mounting direction of the bit 4 relative to the virtual rotation line CL, are not limited to the illustrated examples. For example, the magazine 20 may be attached to the underside or a side face of the successive screw feeder driver 1, or design modifications may be made freely in relation to the opening direction of the screw chain take-out port 20*a*.

The bit 4, which corresponds to the screw-driver as a commonly-used tool, is constituted by a shaft of a polygonal, namely hexagonal, sectional shape. At each of both ends of the bit 4 is formed an engaging convex portion 4*a* for engagement with an engaging groove, such as + groove, formed in the head of each screw B, and a groove (not shown) for engagement with the chuck 19 connected to the clutch 18 is formed circumferentially of the bit 4 at a position near the engaging convex portion 4*a*. The bit 4 can be reversed longitudinally or replaced with a new one according to the degree of wear of the engaging convex portions 4*a* formed at both ends thereof.

The bit 4 is inserted rotatably into the screw feed mechanism body 7, and a guide block 21 is attached to the front end of the screw feed mechanism body. The front end of the guide block 21 is formed with an abutment surface 22 for abutment with an object to be screw-driven with screw B, the abutment surface 22 having an L-shaped groove 22*a* for guiding the screw B to be driven. The screw feed mechanism body 7 is urged in the push-out direction at all times by virtue of the resilience of resilient members such as springs, mounted within the guide poles 17,17. Nearly centrally of the upper surface of the screw feed mechanism body 7 is formed a screw feed groove 23 in the sliding and screw driving direction so that the head of each screw B can be pushed forward while rotating together with the bit 4.

The screw feed mechanism body 7 is provided with a screw chain feed mechanism 24 for feeding the screws B carried side by side on the screw chain 10 to the screw driving position for screw driving with bit 4 successively in interlock with the screw driving operation in the screw feed mechanism body 7. To guide the screw chain 10 drawn out from the take-out port of the magazine 20, a guide cover 25 is mounted on the screw chain feed mechanism 24 in such a manner that it can rise and fall above the screw driving direction and becomes opposed to the groove for the screw head formed in the screw feed mechanism body 7. The guide cover 25 can be largely opened forwardly upward to permit removal of the screw chain 10.

The following description is now provided about how to use the successive screw feeder driver of this invention.

First, the head screw B carried on the screw chain 10 which has been loaded into the screw feed mechanism body 7 in the successive screw feeder driver 1 is brought to the screw driving position for screw driving with bit 4, while the belt-like member projecting sideways of the screw B is allowed to pass into a guide path. At this position, the drive unit 6 is rotated while the abutment surface 22 of the guide block 21 in the screw feed mechanism body 7 is pushed against a plate or the like, and the clutch 18 is engaged while the bit 4 is pushed against the screw B. Then, the bit 4 further rotates to drive the screw B gradually into the wall surface W. At the same time, the screw feed mechanism body 7 (guide block 21) moves back slowly toward the grip handle 2 and stops upon abutment with the rear end portion of the guide block 21 which is integral with the screw feed mechanism body 7, to release the clutch 18. Now, the screw driving work for one screw B is over.

Next, the guide block 21 of the screw feed mechanism body 7 is disengaged from the wall surface W, whereupon the screw feed mechanism body 7 is pushed out to its original position. At the same time, the screw chain feed mechanism 24 operates to feed the next screw B on the screw chain 10 to the screw driving position and the same operations as above are repeated. In this way the screw driving work can be done in a continuous manner.

In the successive screw feeder driver 1, the length of each of the screws B and the width of the screw chain which carries the screws B side by side thereon can be changed according to the thickness of the plate or the wall W into which the screws are to be driven. This can be done as necessary by changing the position of a guide (not shown) formed in the screw feed mechanism body 7.

According to the successive screw feeder driver constructed as above, in performing the screw driving work continuously, if only the operator pushes the supporting and pushing portion formed at the rear portion of the grip handle with the base portion of his or her thumb and forefinger or with the palm portion, the force action line of the pushing hand for the successive screw feeder driver becomes substantially aligned with the virtual rotation line of the bit and hence the screw driving work for a wall surface or the like can be done always in a stable state. Moreover, since a curved portion is formed contiguously to the supporting and pushing portion, the operator's grasping state for the grip handle can be modified into a state suitable for the screw driving work so that the palm can fit the grip handle closely without any clearance, thus making an increase of fatigue difficult even when the successive screw feeder driver is used for a long time. Further, even in the case where the successive screw feeder driver is supported horizontally, since the grip handle is formed substantially at a centroid position and the virtual rotation line of the bit is formed nearly down to the palm position, the feeling of stability in the support is enhanced, thus contributing to the decrease of fatigue feeling and making the successive screw feeder driver suitable for a long-time screw driving work. Thus, extremely outstanding effects are attained by the present invention.

POSSIBILITY OF EXPLORATION IN INDUSTRY

According to the successive screw feeder driver, screws can be driven continuously for fixing a plate such as wooden plate or metallic plate to a wall surface, a floor surface, or the like, the screw driving direction of the grip handle, or the virtual rotation line of the bit axis, and the line of pushing direction of the operator's hand are made nearly coincident with each other, the housing which houses the drive unit therein is positioned above the position where the virtual rotation line of the bit is formed, and the supporting and pushing portion of the grip handle is formed along the underside of the housing, whereby the pushing force of the palm can be transmitted to the front portion of the bit axis exactly and effectively at the time of driving screws.

I claim:

1. A successive screw feeder driver comprising:

a grip handle;

a rotating mechanism provided on an upper side of said grip handle;

a screw driving bit attached removably to a front portion of said rotating mechanism;

a reduction mechanism formed above said rotating mechanism;

a drive unit for rotating said bit, said drive unit being connected to said reduction mechanism so as to be positioned behind and above said grip handle;

a screw feed mechanism body which is mounted to the front portion of said grip handle and which is slidable in a longitudinal direction, with said bit being inserted rotatably into said screw feed mechanism body;

a housing which houses said drive unit therein;

a supporting and pushing portion extending from an upper portion of a rear end of said grip handle to a lower surface of said housing beyond a position where a virtual rotation line extending rearward of an axis of said bit is formed, said supporting and pushing portion being curved so that a palm portion of an operator including a base portion of the operator's thumb and forefinger can push a rear end of said virtual rotation line when the operator grasps said grip handle; and a screw feed mechanism provided in said screw feed mechanism body for feeding screws successively to a screw driving position for screw driving with said bit in interlock with the longitudinal sliding motion of said screw feed mechanism body which motion is synchronized with the screw driving operation performed by said bit, said screws being carried on a screw chain side by side in a large number and in a belt-like arrangement.

2. A successive screw feeder driver according to claim 1, wherein said supporting and pushing portion of said grip handle is curved gently at the upper portion of the grip handle and then projected rearward.

3. A successive screw feeder driver according to claim 1, wherein said grip handle is formed below a substantially centroid portion of a body of the screw feeder driver.

4. A successive screw feeder driver according to claim 1, wherein a protective frame is formed on a front side of said grip handle, said protective frame being integral at a lower end portion with the grip handle.

5. A successive screw feeder driver according to claim 1, wherein said supporting and pushing portion has a thickness almost equal to a thickness of said screw feed mechanism body.

* * * * *